US008044950B2

(12) United States Patent
Satou

(10) Patent No.: US 8,044,950 B2
(45) Date of Patent: Oct. 25, 2011

(54) DRIVER CIRCUIT USABLE FOR DISPLAY PANEL

(75) Inventor: Masanori Satou, Oita (JP)

(73) Assignee: Oki Semiconductor Co., Ltd. (JP)

( * ) Notice: Subject to any disclaimer, the term of this patent is extended or adjusted under 35 U.S.C. 154(b) by 1040 days.

(21) Appl. No.: 11/641,079

(22) Filed: Dec. 19, 2006

(65) Prior Publication Data

US 2007/0176913 A1 Aug. 2, 2007

(30) Foreign Application Priority Data

Jan. 30, 2006 (JP) ..... 2006-021358

(51) Int. Cl.
*G09G 5/00* (2006.01)

(52) U.S. Cl. ..... 345/211; 345/204; 345/212; 345/213; 345/98; 327/96; 327/112; 327/333; 327/563

(58) Field of Classification Search ..... 345/204, 345/211–213, 98–100; 327/563, 112, 333, 327/96

See application file for complete search history.

(56) References Cited

U.S. PATENT DOCUMENTS

| | | | | |
|---|---|---|---|---|
| 5,399,992 | A * | 3/1995 | Itakura et al. | 330/257 |
| 5,675,352 | A * | 10/1997 | Rich et al. | 345/89 |
| 6,392,485 | B1 * | 5/2002 | Doi et al. | 330/253 |
| 6,714,076 | B1 * | 3/2004 | Kalb | 330/255 |
| 6,731,170 | B2 * | 5/2004 | Juang | 330/261 |
| 7,071,669 | B2 * | 7/2006 | Morita | 323/297 |
| 7,098,904 | B2 * | 8/2006 | Kato | 345/211 |
| 2003/0151581 | A1 * | 8/2003 | Suyama et al. | 345/98 |

FOREIGN PATENT DOCUMENTS

JP 2005-192260 7/2005

* cited by examiner

*Primary Examiner* — Lun-Yi Lao
*Assistant Examiner* — Gregory J Tryder
(74) *Attorney, Agent, or Firm* — Studebaker & Brackett PC; Donald R. Studebaker

(57) ABSTRACT

A driver circuit usable for a display panel can generate an output signal in response to an input pulse signal supplied to only one input signal terminal thereof. The driver circuit includes a pulse generating circuit for generating an output signal at the output terminal. The pulse generating circuit has a first and second differential input stage for respectively driving a push-pull construction of output transistors in response to the input pulse signal supplied through the input signal terminal with respect to the push-pull output, whereby to simplify the circuitry, operate at a high slew rate, and decrease electric current consumption.

3 Claims, 5 Drawing Sheets

90:CONTROLLING CIRCUIT
100:OUTPUT AUXILIARY CIRCUIT

DRIVER CIRCUIT USABLE FOR DISPLAY PANEL

1. FIELD OF THE INVENTION

The present invention relates to a driver circuit usable for a display panel.

2. DESCRIPTION OF THE RELATED ART

A conventional driver circuit usable for a display panel such as a liquid crystal display (LCD) panel or an organic electroluminescence (EL) display panel is disclosed by, for example, Japanese Patent Kokai No. 2005-192260 (D1).

A LCD panel disclosed by the document D1 is provided with an active matrix liquid crystal panel and a drive unit for driving the active matrix liquid crystal panel. The liquid crystal panel is formed from a matrix of liquid crystal display elements placed where plural scanning lines and plural data lines are intersected with each other. The drive unit has plural source drivers connected to the data lines and plural gate drivers connected to the scanning lines, both of which are controlled by a controller. Each of the source drivers includes plural driver circuits capable of providing output signals to the liquid crystal elements, whereby light transmittance of the liquid crystal elements is controlled.

FIG. 1 is a circuit diagram showing a driver circuit usable for a display panel, which circuit relates to the present invention.

This driver circuit includes a differential input stage 50, a current mirror part 70, an output stage 80, each of which has plural MOS transistors. The differential input stage 50 inputs an input voltage Vin from an input terminal 1. The push-pull type output stage 80 produces an output voltage Vout from an output terminal 2 thereof.

The differential input stage 50 has a p-type differential input stage 60A and an n-type differential input stage 60B. The p-type differential input stage 60A includes a current source 51, p-channel type MOS (PMOS) transistors 61 and 62. The current source 51 is connected across a power-supply terminal 3, to which a positive power-supply voltage VDD is applied, and a common node N1. The PMOS transistor 61 whose gate is controlled by the input voltage Vin is connected between a common node N1 and a node N13. The PMOS transistor 62 whose gate is controlled by the output voltage Vout is connected between the common node N1 and a node N14. The n-type differential input stage 60B includes a current source 52, n-channel type MOS (NMOS) transistors 63 and 64. The current source 52 is connected between a common node N2 and an earth terminal 4 from which an earth potential of VSS level is supplied. The NMOS transistor 63, whose gate is controlled by input voltage Vin, is connected between a node N11 and the common node N2. The NMOS transistor 64, whose gate is controlled by output voltage Vout, is connected between the node N12 and the common node N2.

The current mirror part 70 includes a PMOS transistor 71, a node N12, a resistor 73, a node N14, and an NMOS transistor 75 which are connected in series across the power-supply terminal 3 and the earth terminal 4. The current mirror part 70 further includes a PMOS transistor 72, a node N11, a resistor 74, a node N13, and an NMOS transistor 76 which are connected in series across the power-supply terminal 3 and the earth terminal 4. Gate terminals of the PMOS transistors 71 and 72 are connected to each other and a drain terminal of the PMOS transistor 71. Gate terminals of the PMOS transistors 75 and 76 are connected to each other and a drain terminal of the PMOS transistor 75.

The push-pull type output stage 80 has a PMOS transistor 81 and an NMOS transistor 82. The PMOS transistor is connected between the power-supply terminal 3 and the output terminal 2 and the NMOS transistor 82 is connected between the output terminal 2 and the earth terminal 4. A gate of the PMOS transistor 81 is controlled by an electrical potential at the node N11. A gate of the NMOS transistor 82 is controlled by an electrical potential at the node N13. A resistor 85 and a condenser 84 for phase compensation are connected in series between the gate and drain terminals of PMOS transistor 81. A resistor 85 and a condenser 86 for phase compensation are connected in series between the gate and drain terminals of NMOS transistor 82.

The input voltage Vin which is a square wave form is supplied to the driver circuit and then the input voltage is amplified at high gain by the differential input stage 50. Driving abilities of the PMOS transistor 81 and the NMOS transistor 82, both of which are complementary to each other, are changed via the current mirror part 70. The driving ability of the PMOS transistor 81 increases in response to a change in level of the input voltage Vin from low level ("L") to high level ("H"), whereas the driving ability of the NMOS transistor 82 decreases. Thus, an output current is supplied from power-supply VDD to a load (e.g., a data line of LCD) connected to the output terminal 2 via the PMOS transistor. In response to a change in level of the input voltage Vin from "H" level to "L" level, the driving ability of the NMOS transistor 82 decreases, whereas the driving ability of the NMOS transistor 82 increases. Thus, an output current is supplied from the load to the earth terminal 4 via the NMOS transistor.

In the driver circuit shown in FIG. 1, the electric currents flowing to the current sources 51 and 52 of the differential input stage 50 are increased constantly for improvement of the threw rate of the output voltage Vout in the case that the driver circuit is used for, for example, a LCD source driver. However, the LCD source driver has a plurality of the driver circuits whose number corresponds to the number of outputs and the electric currents flowing to the differential input stage 50 are increased constantly, thus largely increasing overall consumption of an integrated circuit chip which is integrated with a plurality of the driver circuits.

Therefore, it is technically difficult to realize a driver circuit usable for a display panel that can generate an output voltage at a sufficient high slew rate.

SUMMARY OF THE INVENTION

An object of the present invention is to provide a driver circuit usable for a display panel that can generate an output signal at a high slew rate and decrease electric consumption while avoiding increase of the circuit area.

According to a first aspect of the present invention, there is provided a driver circuit usable for a display panel having an input signal terminal, an output signal terminal, and a pulse generating part which generates an output signal to the output signal terminal in response to an input pulse signal supplied from the input terminal.

The pulse generating part comprises an output stage of a push-pull constitution made of a pair of output transistors, for its push-pull output to the output signal terminal. The pulse generating part also comprises first and second differential amplifier stages for respectively operating the output transistors on the basis of an electric potential at the output signal terminal in response to the input pulse signal. The pulse generating part also comprises two current paths, each of which includes a resistor. The pulse generating part also comprises a current mirror circuit for flowing electric currents of substantially the same magnitude to the two current paths. The pulse generating part also comprises a superimposing stage for superimposing an amplifier signal on output voltages generated by the first and second input differential amplifier stages. The amplifier signal being obtained by amplifying the input pulse signal with reference to the electric potential at the output signal terminal.

The first and second differential amplifier stages are respectively driven by power-supply voltages which are different from each other. A middle point of the output stage is connected to the output signal terminal. One of input terminals of the first differential amplifier stage and one of input terminals of the second differential amplifier stage are connected to the input signal terminal. The other input terminal of the first differential amplifier stage and the other input terminal of the second differential amplifier stage are connected to an electric potential at the middle point of the output stage. One of output terminals of the first differential amplifier stage and one of output terminals of the second differential amplifier stage are connected to gate terminals of the output transistors, respectively. The other output terminal of the first differential amplifier stage and the other output terminal of the second differential amplifier stage are connected to a first referential potential and a second referential potential. The first and second referential potentials are produced at both ends of one of the resistors.

According to the first aspect of the present invention, the driver circuit has the following effects (a) to (c).

(a) The driver circuit includes the superimposing stage which deeply turns on the output transistors, respectively and superimposing electric currents on first and second differential amplifier stages only at the time when the output signal changes. Thus, the driver circuit can generate the output signal at a high slew rate without increasing stationary electric current consumption.

(b) Since electric currents flowing to first and second differential amplifier stages are increased only when the external load is charged and discharged, the driver circuit can charge and discharge a broad range of external load.

(c) The driver circuit having the auxiliary output stage can decrease electric leakage currents flowing to the output transistors of the output stages.

According to a second aspect of the present invention, there is provided the driver circuit according to the first aspect having the pulse generation part further comprising an output stop stage for turning off the output transistors in response to stop signals supplied thereto.

The driver circuit according to the second aspect has effects similar to the first aspect of the present invention. The driver circuit can control charging and discharging of an external load without providing the external switch. The output stage to which the stop signals are supplied are provided with the driver circuit, so that generating timing of the output signal can be arbitrarily changed. The driver circuit is effective for driving a LCD source driver etc. that especially need a high-impedance performance.

DETAILED DESCRIPTION OF THE INVENTION

Figure 1:
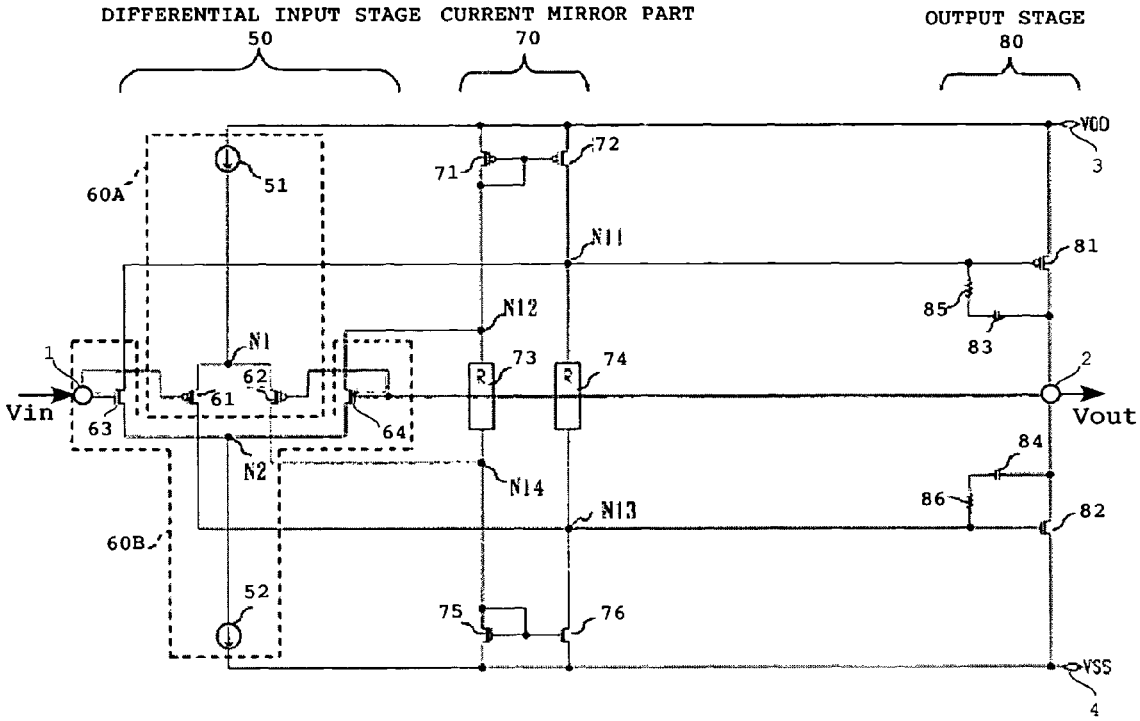
FIG. 1 is a circuit diagram showing a driver circuit usable for a display panel, which circuit relates to the present invention.

Embodiments of the present invention will be described below with reference to FIGS. 2 to 5. Components in FIGS. 2, 4, and 5 which operate in the same manner are denoted by the same reference numerals.

A driver circuit includes a first differential input stage, a second differential input stage, a current mirror part, push-pull type output stage, first and second auxiliary current sources, a power output auxiliary circuit, and a controlling part.

The first differential input stage has a first MOS transistor and a second MOS transistor. The first MOS transistor whose gate is controlled by an electric potential at an input terminal is connected across a first current source and a third node. The second MOS transistor whose gate is controlled by an electric potential at an output terminal is connected across the first current source and a fourth node. The second differential input stage has a third MOS transistor and a fourth MOS transistor. The third MOS transistor whose conductivity is controlled by the electric current at the input terminal is connected across a first node and a second current source. The fourth MOS transistor whose gate is controlled by the electric potential at the output terminal is connected to a second node and the second current source. The current mirror part supplies a first power supply current to the second node and the fourth node. The current mirror part also supplies a second power supply current whose magnitude corresponds to the first power supply current to the first and third node.

The push-pull type output stage has a first output MOS transistor and a second output MOS transistor. The first output MOS transistor is controlled by an electric potential at the first node. The second output MOS transistor, which is connected in series to the first output transistor via the output terminal, is controlled by an electric potential at the third node. The first auxiliary current source having a third current source and a fifth MOS transistor connected to the third current source is connected in parallel to the first current source. The second auxiliary current source having a fourth current source and a sixth MOS transistor connected to the fourth current source is connected in parallel to the second current source.

The power output auxiliary circuit has a seventh MOS transistor connected across the first node and the output terminal and a eighth MOS transistor connected across the third node and the output terminal. The controlling part controls gates of the fifth and seventh transistors and the sixth and eighth MOS transistors on the basis of a difference in potential between the input and output terminals.

First Embodiment

Figure 2:
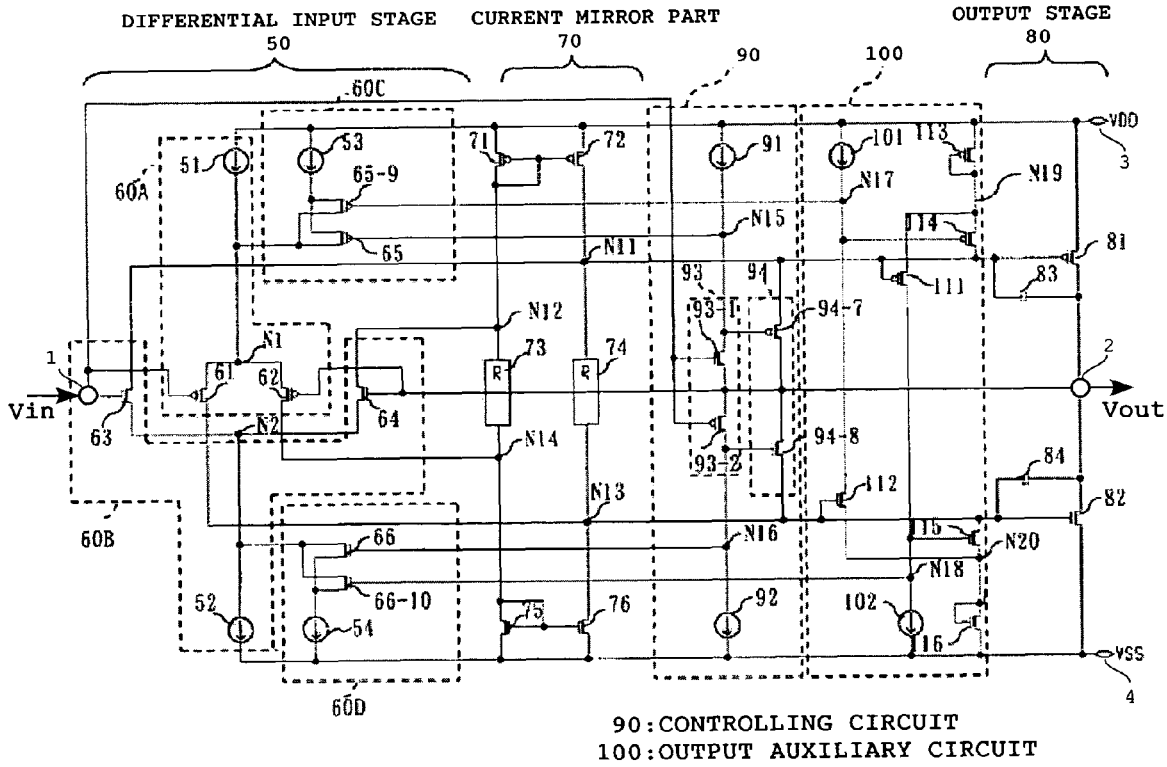
FIG. 2 is a circuit diagram showing a driver circuit usable for a display panel, which circuit is a first embodiment of the present invention.

FIG. 2 is a circuit diagram showing a driver circuit that is a first embodiment of the present invention.

This driver circuit operational at a high slew rate includes a differential input stage 50, a current mirror part 70, a push-pull type output stage 80, a first auxiliary current source part 60C, a second auxiliary current source part 60D, a controlling circuit 90, and a power output auxiliary circuit 100. The differential input stage 50 has a first differential input stage 60A which is a first conductive type (e.g., a p-type differential input stage) and a second differential input stage which is a second conduction type (e.g., an N-type differential input stage).

The p-type differential input stage 60A has a first current source 51, a first transistor (e.g., a PMOS transistor) 61, and a second transistor (e.g., a PMOS transistor) 62. The first current source 51 is connected to a power-supply terminal 3 from which a power-supply voltage of VDD level is supplied and a common node N1. The first transistor 61, whose gate is controlled by an input voltage Vin supplied from an input terminal 1 thereof, is connected across the common node N1 and a third node N13. The second transistor 62, whose gate is controlled by an output voltage Vout from an output terminal 2 thereof, is connected across the common node N1 and a node N14.

The n-type differential input stage 60B has a second current source 52, a third transistor (e. g, an NMOS transistor) 63, and a fourth transistor (e.g., an NMOS transistor) 64. The second current source 52 is connected across a common node N2 and an earth terminal 4 from which an earth potential VSS is supplied. The third transistor 63, whose gate is controlled by the input voltage Vin, is connected across the node N11 and the common node N2. The fourth transistor 64, whose gate is controlled by the output voltage Vout, is connected across the node N12 and the common node N2.

The current mirror part 70 supplies a first power supply electric current to the node N12 and the node N14 and also supplies a second power supply electric current, whose magnitude corresponds to the first power supply electric current, to the node N11 and the node N13. The current mirror part 70 has a PMOS transistor 71, a second node N12, a resistor 73, a fourth node N14, and an NMOS transistor 75 which are connected in series across the power-supply terminal 3 and the earth terminal 4. In addition, this current mirror part 70 has a PMOS transistor 72, a first node N11, a resistor 74, a third node N13, and an NMOS transistor 76. Gate terminals of the PMOS transistors 71 and 72 are connected to each other. The gate and drain terminals of the PMOS transistor 71 are connected to each other. Gate terminals of the NMOS transistors 75 and 76 are connected to each other. The gate and drain terminals of the NMOS transistor 75 are connected to each other.

The push-pull type output stage 80 has a first output transistor (e.g., a PMOS transistor) 81 and the 2nd output transistor (e.g., an NMOS transistor) 82, which are connected in series across the power-supply terminal 3 and the earth terminal 4. The first output transistor 81 is driven by an electrical potential at the node N11. The second output transistor 82 is driven by an electrical potential at the third node N13. A capacity 83 for phase compensation is connected across the gate and drain terminals of the PMOS transistor 81, and a capacity 84 for phase compensation is connected across the gate and drain terminals of the NMOS transistor 82.

The first auxiliary current source part 60C has a third current source 53 and a fifth transistor (e.g., a PMOS transistor) 65 which is connected to the third current source 53. The third current source 53 and the fifth transistor 65 are connected in parallel to the first current source 51. The gate of the fifth transistor 65 is controlled by an electrical potential of the node N15. A ninth transistor (e.g., a PMOS transistor) 65-9 whose gate is controlled by the electrical potential at a seventh node N17 is connected in parallel to the PMOS transistor 65. The second auxiliary current source part 60D has a fourth current source 54 and a sixth transistor (e.g., an NMOS transistor) 66 which are connected in parallel to the second current source 52. The gate of the sixth transistor 66 is controlled by an electrical potential at the node N16. Moreover, a tenth transistor (e.g., an NMOS transistor) 66-10 whose gate is controlled by an electrical potential at the node N18 is connected in parallel to the NMOS transistor 66.

The controlling circuit 90 has a controlling part 93, an output stage auxiliary part 94, and current sources 91 and 92. The current sources 91, the control unit 93, and the current source 92 are connected in series between the power-supply terminal 3 and the earth terminal 4. The output stage auxiliary part 94 is connected across the first node N11 and the third node N13. Control unit 93 has the first detection transistor 93-1 (e.g., an NMOS transistor) and the second detection transistor 93-2 (e.g., a PMOS transistor) which are connected in series between the fifth node N15 and the sixth node N16. The controlling part 93 controls gates of the PMOS transistor 65, a seventh transistor (e.g., a PMOS transistor) 94-7, an NMOS transistor 66, and an eighth transistor (e.g., an NMOS transistor) 94-8 on the basis of an electric potential difference between the input terminal 1 and the output terminal 2. Gate terminals of the NMOS transistor 93-1 and the PMOS transistor 93-2 are connected to the input terminal 1. Source terminals of the NMOS transistor 93-1 and the PMOS transistor 93-2 are connected to the output terminal 2.

The output stage auxiliary part 94 has a seventh transistor 94-7 (e.g., a PMOS transistor) connected across the node N11 and output terminal 2 and a eighth transistor 94-8 (e.g., an NMOS transistor) connected across the node N13 and output terminal 2. The gate of the PMOS94-7 is connected to the node N15. The gate of NMOS94-8 is connected to the node N16.

The output auxiliary circuit 100 has a current source 101, a current source 102, a first control transistor (e.g., a PMOS transistor) 111, a second control transistor (e.g., an NMOS transistor) 112, a PMOS transistor 113, a PMOS transistor 114, an NMOS transistor 115, and an NMOS transistor 116. The current source 101 is connected across the power-supply terminal 3 and the seventh node N17. The current source 102 is connected across the eighth node N18 and the earth terminal 4. The PMOS transistor 113, the PMOS transistor 114, the NMOS transistor 115, and the NMOS transistor are diode-connected.

A PMOS transistor 113, a nineteenth node N19, and a PMOS transistor 114 are connected in series between the power-supply terminal 3 and the first node N11. An NMOS transistor 115, a twentieth node N20, and an NMOS transistor 116 are connected in series across the node N13 and the earth terminal 4. Source and drain terminals of the PMOS transistor 111 are connected across the nineteenth node N19 and the eighteenth node N18. Gate terminal of the PMOS transistor 111 is connected to the first node N11. The PMOS transistor 111 controls the gate of NMOS transistor 66-10 (the eighteenth node N18) on the basis of the electrical potential at the node N11. The PMOS transistor also fixes the electrical potential at the node N13. Drain and source terminals of the NMOS transistor 112 are connected across a seventeenth node N17 and the twentieth node N20. Gate terminal of the NMOS transistor 112 is connected to the third node N13. The NMOS transistor 112 which is complementary to the PMOS transistor 111 controls the gate of PMOS transistor 65-9 on the basis of the electrical potential at the third node N13. The NMOS transistor 112 also fixes the electrical potential at the first node N11.

The driver circuit performs the following operations (A) and (B) in sequence so as to operate at a high slew rate and decrease electric current consumption.

(A) In response to a change in level of the input voltage Vin from "L" level voltage to "H" level, the driver circuit performs the following operations (1) to (7) in sequence.

(1) The source-follower type NMOS transistor 93-1, which detects a potential difference between the input terminal 1 and the output terminal 2, is turned on and thus an electrical potential at the node N15 decreases.

(2) The PMOS transistor 94-7 is turned on in response to the decrease in the electrical potential at the node N15. An electrical potential at the node N11 to which the output terminal 2 are connected via the PMOS transistor 94-7 rapidly decreases, thus turning on the PMOS transistor 81 of the output stage 80 deeply. Then, the electric potential at the output terminal 2 rapidly increases, thus increasing the slew rate of the output voltage Vout.

(3) At the same time, the PMOS transistor 65 is turned on and thus an electric current flowing to the p-type differential input stage 60A increases. Electric currents flowing to the NMOS transistors 75 and 76 increase, so that an electric potential at the node N13 decreases. These operation of the driver circuit can decrease a leakage current passing from the power-supply terminal 3 to the earth terminal 4 through the output stage 80 when the electric potential at the output terminal 2 rapidly increases and improve the threw rate of the output voltage Vout.

(4) The electric potential at the node N11 rapidly decreases and thus the PMOS transistor 111 is turned on. At this time, an electric potential at the node N18 rises to an electric potential at the node N19. The NMOS transistor 66-10 is turned on and thus the electric current of N-type differential input stage 60B is increased. The NMOS transistor 115 is turned on. The electric potential at the node N13 is fixed at an electric potential at the node N20, and thus the leakage current flowing to the output stage 80 is prevented.

(5) The electric potential at the output terminal 2 rapidly increase and then the potential difference between the input terminal 1 and the output terminal 2 becomes less than a voltage (a threshold voltage Vt–a gate-source voltage Vgs of transistor 93-1). The NMOS transistor 93-1 is turned off. Since the electrical potential at the node N15 becomes the VDD level, the PMOS transistor 65 and the PMOS transistor 94-7 are also turned off.

(6) Since the potential difference between input terminal 1 and output terminal 2 causes at this time and the electric potential at the node N11 decreases, the PMOS transistor 111 is on state. The electric current keeps flowing to the N-type differential input stage 60B until the PMOS 111 is turned off, and thus the electric potential at the output terminal 2 converges to a desired target voltage at a short settling time period.

(7) The electric potential at the node N11 increases and thus the PMOS transistor 111 is turned off. An electric potential at the node N18 reaches to the VSS level, and then the sequential high slew rate operations end and the driver circuit changes to a regular operation.

(B) In response to a change in level of the input voltage Vin from the "H" level voltage to the "L" level voltage performs the following operations (1) to (7).

(1) The source follower PMOS transistor 93-2, that detects the potential difference between the input terminal 1 and the output terminal 2, is turned on, and the electrical potential at the node N16 increases.

(2) An electric potential at the node N16 increases and thus the NMOS transistor 94-8 is turned on. The electric potential at the node N13, which is connected to the output terminal 2 via the NMOS transistor 94-8, rapidly increases, thus turning on the NMOS transistor 82 of the output stage 80 deeply. Then, the electric potential at the node N13 rapidly increases, thus increasing the slew rate of the output voltage Vout.

(3) At the same time, the NMOS transistor 66 is turned on and the electric current flowing to the N-type differential input stage 60B increases. An electric current flowing to the PMOS transistor 71 increases, thus increasing an electric current flowing to the PMOS 72 via the current mirror part 70 and increasing the electric potential at the node N11. These operation of the driver circuit can decrease a leakage current passing from the earth terminal 4 to the power-supply terminal 3 through the output stage 80 when the electric potential at the output terminal 2 rapidly decreases and improve the threw rate of the output voltage Vout.

(4) The electric potential at the node N13 rapidly increases and thus the NMOS transistor 112 is turned on. The electric potential at the node N17 decreases and then reaches to the electric potential at node N20, thus turning on the PMOS transistor 65-9. Then, the electric current flowing to the p-type differential input stage 60A and the PMOS transistor 114 is turned on. The electric potential at the node N11 is fixed at the electric potential at the node N19, and thus the leakage current flowing to the output stage 80 is prevented.

(5) The electric potential at the output terminal 2 rapidly decreases. When the potential difference between input terminal 1 and output terminal 2 becomes less than a voltage given by Vt subtracted from Vgs where Vt is a threshold voltage of the PMOS transistor 93-2 and Vgs is a gate-source voltage of the PMOS transistor 93-2, the PMOS transistor 93-2 is turned off. Since the electrical potential at the node N16 becomes the VSS level, the NMOS transistor 66 and NMOS transistor 94-8 are also turned off.

(6) Since there is still the potential difference between input terminal 1 and output terminal 2 and the electric potential at the node N13 increases, the NMOS transistor 112 is turned on. The electric current keeps flowing to the p-type differential input stage 60A until the NMOS transistor 112 is turned off, and then the electric potential at the output terminal 2 reaches to the target electric potential at a short settling time period.

(7) The electric potential at the node N13 decreases and thus the PMOS transistor 112 is turned off. An electric potential at the node N18 reaches to the VSS level, and then the sequential high slew rate operations end and the driver circuit changes to a regular operation.

Figure 3:
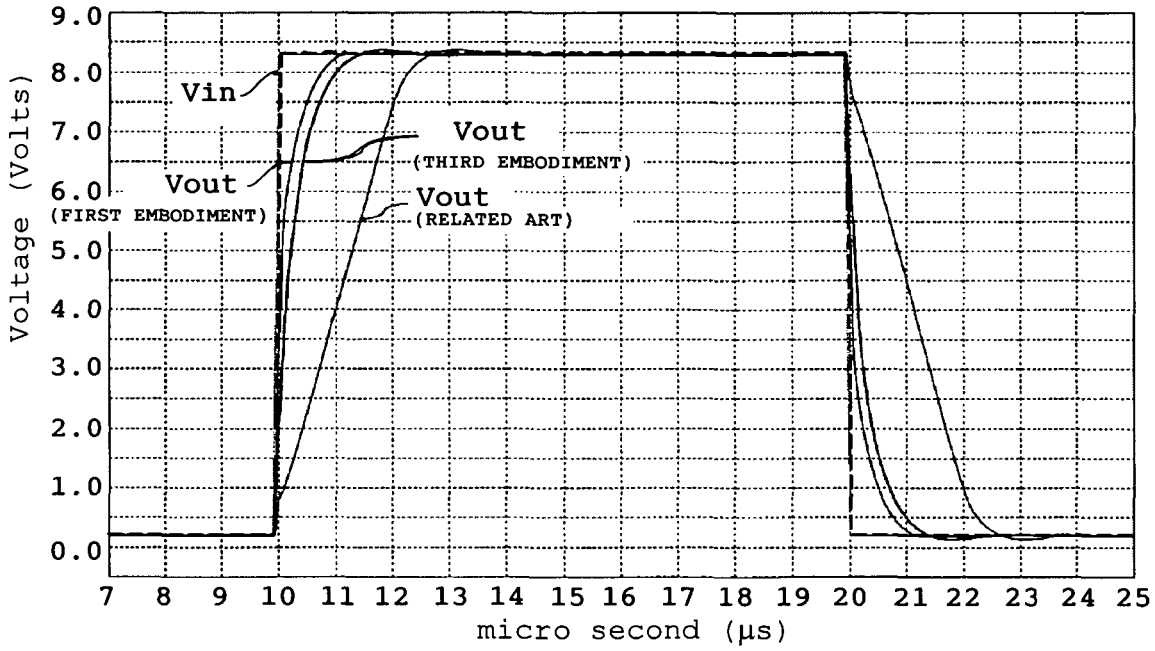
FIG. 3 is a wave form chart showing simulation output voltages generated from driver circuits according to the present invention.

FIG. 3 is a wave form chart showing simulation output voltages Vout generated from driver circuits according to the present invention. For comparison, the output voltage Vout generated from the related art in FIG. 1 is also shown in FIG. 3.

The first embodiment of the present invention has the following effects (a) to (d).

(a) The driver circuit of the first embodiment includes the controlling circuit 90 having the NMOS transistor 93-1 and PMOS transistor 93-2 which increase driving abilities of the PMOS 81 and NMOS 82, respectively. The electric currents flowing to the differential input stage 50 are superimposed on only when the output voltage Vout changes. Therefore, the driver circuit of the second embodiment can generate the output voltage Vout at a high slew rate without increasing stationary electric current consumption.

(b) Since differential electric currents are increased only when an external load is charged and discharged, the driver circuit can charge and discharge a various external load.

(c) The driver circuit includes the output auxiliary circuit 100, thus decreasing the leakage current flowing through the output stage 80.

(d) The driver circuit can reduce overshoot around a leading-edge of the output voltage Vout and undershoot around a trailing-edge of the Vout. The driver circuit also can and charges and discharges the external load at a short settling time period.

Second Embodiment

Figure 4:
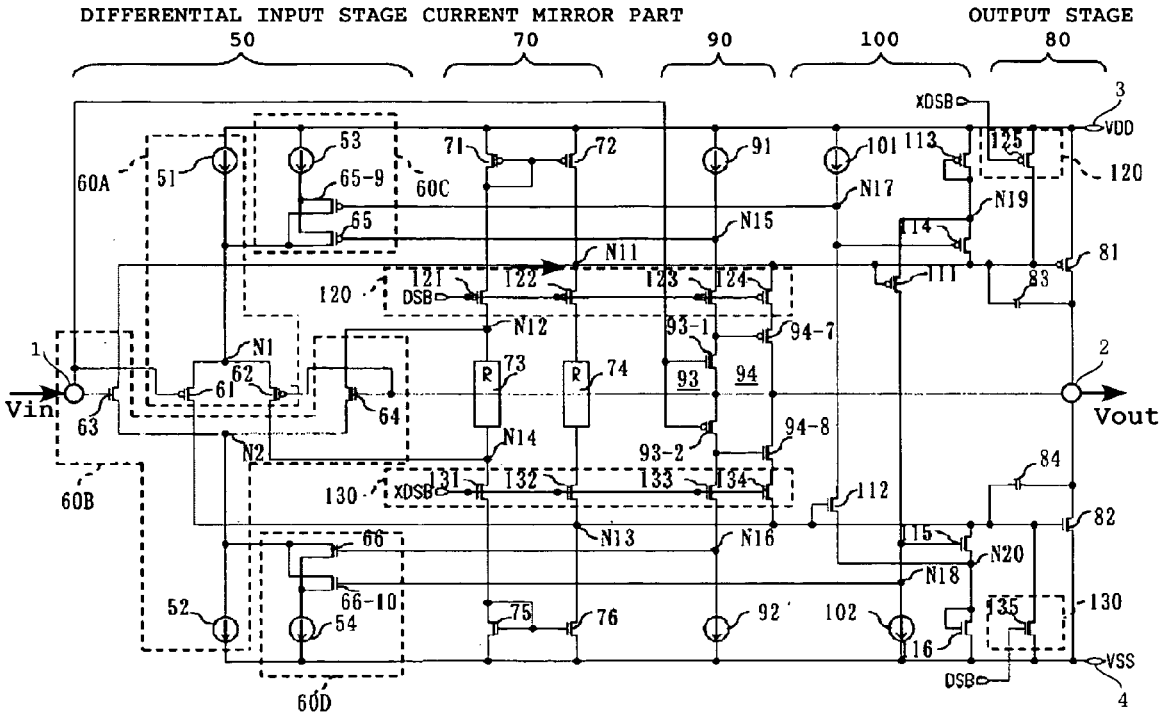
FIG. 4 is a circuit diagram showing a driver circuit usable for a display panel, which circuit is a second embodiment of the present invention.

FIG. 4 is circuit diagram showing a driver circuit that is a second embodiment of the present invention. Components in FIG. 4 which operate in the same manner as those in FIG. 2 are denoted by the same reference numerals.

In the driver circuit of the second embodiment, a P-type output stop part 120 and an N-type output stop part 130 are added to the first embodiment.

The output stop parts 120 and 130 are so configured that electrical potentials at nodes N11 and N13 are fixed on the basis of complementary control signals DSB (e.g., VDD) and XDSB (e.g., VSS). The output stop parts 120 and 130 are also so configured that a PMOS transistor 81 and an NMOS transistor 82 of an output stage 80 are turned off at the same time.

The P-type output stop part 120 has PMOS transistors 121, 122, 123, and 124 whose gate are controlled by the control signal DSB and a PMOS transistor 125 whose gate is controlled by the control signal XDSB having a reversed phase. Source and drain terminals of the PMOS transistor 121 is connected across a drain terminal of a PMOS transistor 71 and a node N12. Source and drain terminals of the PMOS transistor 122 is connected across a node N11 and a resistor 74. Source and drain terminals of the PMOS transistor 123 is connected across a node N15 and a drain terminals of an NMOS transistor 93-1. Source and drain terminals of the PMOS transistor 124 is connected across the node N11 and a source terminal of a PMOS transistor 94-7. Source and drain terminals of the PMOS transistor 125 is connected across a power-supply terminal 3 and the node N11.

The N-type output stop part 130 has NMOS transistors 131, 132, 133, and 134 whose gate are controlled by the reversed phase control signal XDSB and an NMOS transistor 135 whose gate is controlled by the control signal DSB. Drain and source terminals of the NMOS transistor 131 is connected across a node N14 and a drain terminal of a NMOS transistor 75. Drain and source terminals of the NMOS transistor 132 is connected across a resistor 74 and a node N13. Drain and source terminals of the NMOS transistor 133 is connected across a drain terminal of a PMOS transistor 93-2 and a node N16. Drain and source terminal of the NMOS transistor 134 is connected across a source terminal of an NMOS transistor 94-8 and the node N13. Drain and source terminals of the NMOS transistor 135 is connected across the node N13 and an earth terminal 4. Other components are similar to that of the first embodiment.

The driver circuit of the second embodiment sequentially performs the following operations (A) and (B).

(A) The driver circuit of the second embodiment operates similarly to the first embodiment in response to a change in level of the input voltage Vin from "L" to "H" level when the control signal DSB is VSS level (the reversed phase control signal XDSB is VDD level).

(B) When the control signal DSB is VDD level (the reversed phase control signal XDSB is VSS level), in response to a change in level of the input voltage Vin from "H" level to "L" level, the PMOS transistors 121 to 124 and the NMOS transistors 131 to 134 are turned off. PMOS transistor 125 and the NMOS transistor 135 are also turned on. An electrical potential at the node N11 reached to VDD level and an electrical potential at the node N13 reaches to VSS level. The output terminal 2 is connected to an external device having high impedance. Therefore, the power output voltage Vout does not change even if the input voltage Vin changes. And then the driver circuit performs operations similar to those of the first embodiment when the control signal DSB changes in level to "VSS" level (the reversed phase control signal XDSB changes in level to "VDD" level).

The second embodiment has effects similar to the first embodiment. A typical external device having high impedance connected to an output terminal is usually controlled by an switch provided outside of a driver circuit. It is difficult for the driver circuit having the external switch to perform at a high slew rate because of a resistance of the switch. The second embodiment can charge or discharge the external load without providing the external switch.

The terminals, to which the control signal DSB and the reversed phase control signal XDSB are supplied, are added to the driver circuit, so that timing of the output voltage Vout can be arbitrarily changed. The output stop parts 120 and 130 are effective for a LCD source driver etc. that especially need the Hi-Z performance.

Third Embodiment

Figure 5:
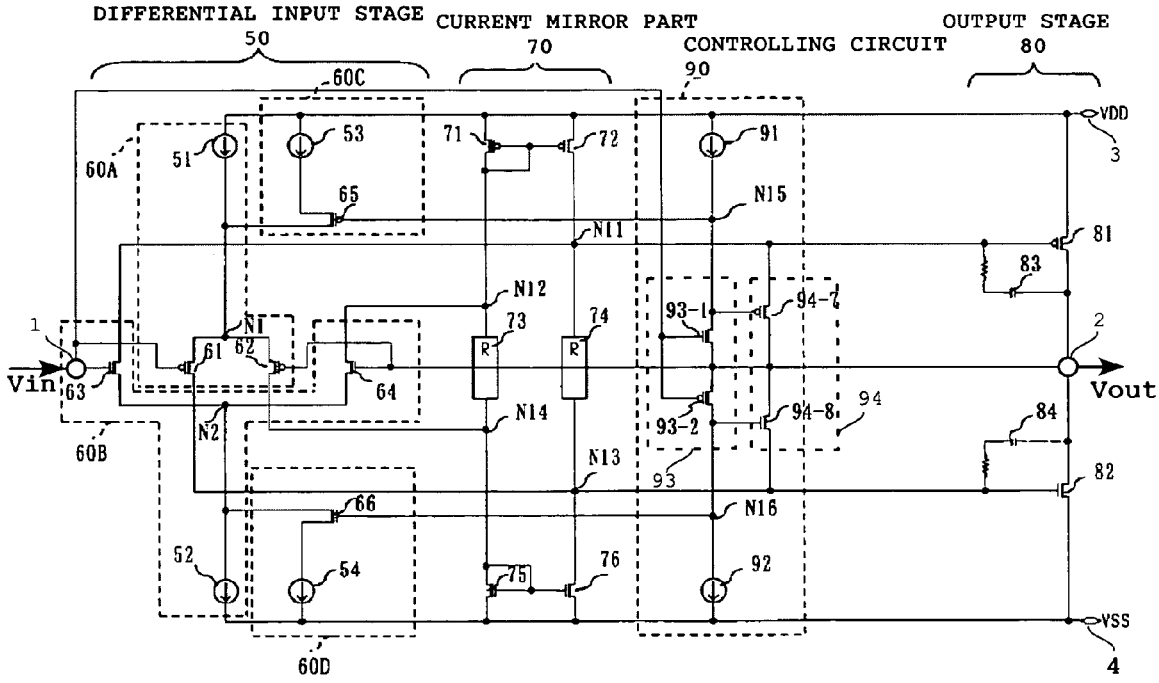
FIG. 5 is a circuit diagram showing a driver circuit usable for a display panel, which circuit is a third embodiment of the present invention.

FIG. 5 is a circuit diagram showing a driver circuit that is a fourth embodiment of the present invention. Components in FIG. 5 which operate in the same manner as those in FIG. 2 are denoted by the same reference numerals.

In the driver circuit of the third embodiment, the PMOS transistor 65-9 and the NMOS transistor 66-10 are deleted from the first auxiliary current source part 60C and the second auxiliary current source part 60D, respectively, both of which are included by the driver circuit of the first embodiment. The output auxiliary circuit 100 for controlling gated of the PMOS transistor 65-9 and the NMOS transistor 66-10 are also the output auxiliary circuit 100 of the first embodiment Other components are similar to those of the first embodiment.

The driver circuit of the third embodiment sequentially performs operations (1), (2), (3), and (5) which are described in the first embodiment and performs to a regular operation.

FIG. 3 is the wave form chart showing simulation output voltages generated from driver circuits according to the present invention. As shown in FIG. 3, the third embodiment can generate the output voltage Vout at more higher slew rate than the related art.

It is understood that the third embodiment of the present invention has effects of improvement in the slew rate. A settling time is estimated to be 0.7 micro second, which means the third embodiment can operates at a high slew rate.

The present invention is not limited to the first to third embodiments and may be modified as follows:

(a) By controlling in level of electric currents of the current sources 51, 52, 91, 92, 101, and 102 of the first and second embodiments and electric currents of the current sources 51, 52, 91, and 92 of the third embodiment, and in addition by controlling a slew rate of the output voltage, electric current consumption of the driver circuit can be decreased.

(b) The conductive type of the MOS transistors described in the embodiments may be changed. That is, the PMOS transistors may be changed to NMOS transistors and the NMOS transistors may be changed to PMOS transistors. The MOS transistors of the first to third embodiments may be changed to other transistors such as bipolar transistors. The driver circuit of the first to third embodiments may be modified to other circuit structures.

(c) The driver circuits of the first to third embodiments can be applied to a display apparatus that drives various display panels such as a liquid crystal panel and an organic EL panel, etc.

This application is based on Japanese Application No. 2006-021358 which is hereby incorporated by reference.

What is claimed is:

1. A driver circuit usable as a driver driving a display panel and having an input signal terminal, an output signal terminal, and a pulse generating part which generates an output signal and supplies the output signal to said output signal terminal in response to an input pulse signal supplied thereto through said input signal terminal, said pulse generating part comprising:

an output stage of a push-pull constitution made of a pair of output transistors, for supplying its push-pull output to said output signal terminal;

first and second differential amplifier stages for respectively driving said output transistors on the basis of an electric potential at said output signal terminal in response to said input pulse signal;

two current paths, each of which includes a resistor;

a current mirror circuit for providing electric currents of substantially the same magnitude as each other to said two current paths, respectively; and a control circuit connected between said input and output terminals for detecting an electric potential difference between said input and output terminals and for controlling said pair of output transistors and a superimposing stage in response to the detected electric potential difference, said superimposing stage superimposing an amplifier signal on output voltages generated by said first and second input differential amplifier stages, said amplifier signal being obtained by amplifying said input pulse signal with reference to said electric potential at an amplifying rate reflecting the detected electric potential difference, wherein said control circuit further includes a push-pull amplifier for respectively superimposing bias voltages obtained by amplifying said potential difference to control terminals of said pair of output transistors, said first and second differential amplifier stages are respectively driven by power-supply voltages which are different from each other, a middle point of said output stage is connected to said output signal terminal, one of input terminals of said first differential amplifier stage and one of input terminals of said second differential amplifier stage are connected to said input signal terminal, the other input terminal of said first differential amplifier stage and the other input terminal of said second differential amplifier stage are connected to an electric potential at said middle point of said output stage, one of output terminals of said first differential amplifier stage and one of output terminals of said second differential amplifier stage are connected to gate terminals of said output transistors, respectively, the other output terminal of said first differential amplifier stage and the other output terminal of said second differential amplifier stage are connected to a first referential potential and a second referential potential, and said first and second referential potentials are produced at both ends of one of said resistors.

2. A driver circuit usable for a display panel according to claim 1, said pulse-generating part further comprising an auxiliary output stage for superimposing an auxiliary voltage on said output voltage generated by each of said first and second differential amplifier stages, so as to increase magnitude of variations in said output voltages generated by said first and second differential amplifier stages.

3. A driver circuit usable for a display panel according to claim 1, said pulse-generating part further comprising an output stop stage for turning off said output transistors in response to stop signals supplied thereto.

* * * * *